US006587049B1

(12) United States Patent
Thacker

(10) Patent No.: US 6,587,049 B1
(45) Date of Patent: Jul. 1, 2003

(54) OCCUPANT STATUS MONITOR

(76) Inventor: Ralph W. Thacker, P.O. Box 1416, Ferndale, CA (US) 95536

( * ) Notice: Subject to any disclaimer, the term of this patent is extended or adjusted under 35 U.S.C. 154(b) by 29 days.

(21) Appl. No.: 09/683,173

(22) Filed: Nov. 28, 2001

Related U.S. Application Data

(63) Continuation-in-part of application No. 09/652,551, filed on Aug. 31, 2000, now Pat. No. 6,359,564, which is a continuation-in-part of application No. 09/431,718, filed on Oct. 28, 1999, now Pat. No. 6,147,608.

(51) Int. Cl.[7] ..... G08B 23/00

(52) U.S. Cl. ..... 340/573.1; 340/573.4; 340/521; 340/522; 340/330; 340/331

(58) Field of Search ..... 340/573.1, 573.4, 340/521, 522, 330, 331

(56) References Cited

U.S. PATENT DOCUMENTS

| | | | | |
|---|---|---|---|---|
| 3,964,058 A | | 6/1976 | Winston | |
| 4,679,034 A | | 7/1987 | Kamada | |
| 5,305,390 A | * | 4/1994 | Frey et al. | 340/556 |
| 5,640,141 A | | 6/1997 | Myllymaki | |
| 5,701,117 A | * | 12/1997 | Platner et al. | 340/567 |
| 5,703,368 A | * | 12/1997 | Tomooka et al. | 250/349 |
| 5,764,146 A | * | 6/1998 | Baldwin et al. | 340/567 |
| 5,785,347 A | | 7/1998 | Adolph et al. | |
| 5,861,806 A | | 1/1999 | Vories et al. | |
| 5,877,688 A | | 3/1999 | Morinaka et al. | |
| 5,905,436 A | * | 5/1999 | Dwight et al. | 340/573.1 |
| 5,971,597 A | | 10/1999 | Baldwin et al. | |
| 6,014,942 A | | 1/2000 | Perka et al. | |
| 6,026,340 A | * | 2/2000 | Corrado et al. | 701/47 |
| 6,078,253 A | | 6/2000 | Fowler | |
| 6,081,757 A | | 6/2000 | Breed et al. | |
| 6,137,407 A | | 10/2000 | Akagawa et al. | |
| 6,188,318 B1 | | 2/2001 | Katz et al. | |
| 6,211,783 B1 | | 4/2001 | Wang | |
| 6,222,191 B1 | | 4/2001 | Myron et al. | |
| 6,236,303 B1 | | 5/2001 | Wagner et al. | |
| 6,246,321 B1 | | 6/2001 | Rechsteiner et al. | |

* cited by examiner

*Primary Examiner*—Daniel J. Wu
*Assistant Examiner*—Hung Nguyen
(74) *Attorney, Agent, or Firm*—McGarry Bair PC

(57) ABSTRACT

A system is disclosed for using passive infrared technology to analyze the thermal energy in a given space, to determine whether a person is present, and if so, whether he or she is experiencing an emergency or a normal physical state. A detector mounted on the wall or ceiling collects the thermal data. A microprocessor in a desk top control module or a personal computer determines occupant status from the data and instructs a wall-mounted indicator to activate occupant status signals. The preferred signals are: an intermittent red light and tone for emergencies, a green light for normal states, and an amber light for absences. Occupant status signals and silent alerts may be transmitted to and from other locations via a communications network. The invention also warns of possible fire danger. Additionally, it may be used to control lights and office machines and integrated with building security systems.

39 Claims, 13 Drawing Sheets

OCCUPANT STATUS MONITOR

CROSS REFERENCE TO RELATED APPLICATIONS

This application is a continuation-in-part of U.S. application Ser. No. 09/652,551, filed Aug. 31, 2000 now U.S. Pat. No. 6,359,564, which is a continuation-in-part of U.S. application Ser. No. 09/431,718, filed Oct. 28, 1999 now U.S. Pat. No. 6,147,608.

BACKGROUND OF INVENTION

1. Field of the Invention

The present invention relates to systems for analyzing the characteristics of thermal energy relative to a space, for recognizing the presence of a person in the space, and for determining whether or not the person is experiencing a physical emergency.

2. Description of the Prior Art

Understanding of the present invention rests on the distinction between occupant status and occupancy status. Occupancy status is concerned with establishing whether a given space is occupied. Occupancy status systems are typically employed to detect intrusion or to control environmental factors. Occupant status is focused on the disposition of the occupant, once his or her presence in a given space has been established. For example, occupant status involves identifying whether a person present in a space is experiencing a possible emergency or is in a normal physical state. Furthermore, occupant status may entail determining how the person, when in a normal state, is relating to the space, i.e., whether he or she is willing to be disturbed and whether his or her absences from the space are for a short or a long duration. Making such determinations necessitates the sensing of two or more of the physical attributes (physical state indicia) of the person relative to the designated space and analyzing them separately and jointly (the process of sensor fusion). Occupant status may also include displaying a unique signal for each physical condition identified.

Several methods are known for manually signaling the wish not to be disturbed or the need for assistance by a person present in a given space as representatively disclosed by Winston (see, U.S. Pat. No. 3,964,058), Perka, et al. (see, U.S. Pat. No. 6,104,942) and Wagner, et al. (see, U.S. Pat. No. 6,236,303). However, these methods are limited by the possibility that the person present in the space may be unable to perform the manual activity required to activate the desired signals or may neglect to do so.

Various methods are also known for employing a single motion sensor to detect occupancy in a space as representatively disclosed by Kamada (see, U.S. Pat. No. 4,679,034), Myllymaki (see, U.S. Pat. No. 5,640,141), and Vories, et al. (see, U.S. Pat. No. 5,861,806). However, these methods cannot reliably detect the presence of a person in a designated space since they may be activated by motion outside the designated space or by motion within the space that is caused by a source other than a person. Moreover, these methods cannot determine occupant status since they consider only one aspect of a person's behavior, namely motion. These same limitations are found in the multiple-sensor systems such as disclosed by Baldwin, et al. (See, U.S. Pat. No. 5,971,597), which employs a motion sensor to detect occupancy and other types of sensors to detect light and temperature for the purpose of controlling a building's electrical and/or mechanical systems.

Several methods are known for using multiple motion sensors to detect the occupancy of a space as representatively disclosed by Fowler (see, U.S. Pat. No. 6,078,253), Katz, et al. (see, U.S. Pat. No. 6,188,318), Wang (see, U.S. Pat. No. 6,211,783) and Myron, et al. (see, U.S. Pat. No. 6,222,191). While the employment of multiple motion sensors may produce more reliable occupancy status by reducing the incidence of false triggering, the concentration on motion alone precludes the making of determinations about occupant status. Additionally, several methods are known for employing multiple motion sensors arranged to stratify the reception of input from a given space as representatively disclosed by Tomooka, et al. (see, U.S. Pat. No. 5,703,368) and Dwight, et al. (see, U.S. Pat. No. 5,905,436). These systems may be able to detect when a person's motion is confined to the lower level of reception. However, they cannot determine the physical status of the person since they lack the ability to detect whether the motion being evidenced from the lower level of reception is normal or abnormal and, most importantly, to detect when the person is present but not moving. Methods are also known for utilizing motion sensing and/or thermal sensing to determine human occupancy in a given space as disclosed by Morinaka, et al. (see, U.S. Pat. No. 5,877,688), Akagawa, et al. (see, U.S. Pat. No. 6,137,407), and Rechsteiner, et al. (see, U.S. Pat. No. 6,246,321). While these methods utilize cross-technology sensors to make detection of human occupancy more certain, they do not employ sensor fusion to make determinations about the status of the occupant.

Finally, several methods are known for employing sensors that embody differing technologies and sensor fusion to determine the status of a passenger in an automobile and to activate an air bag as representatively disclosed by Adolf, et al. (see, U.S. Pat. No. 5,785,347), Corrado, et al. (see, U.S. Pat. No. 6,026,340), and Breed, et al. (see, U.S. Pat. No. 6,081,757). However, these methods do not determine multiple passenger conditions or employ indicators to signal information about the passenger's status. Rather, they gather passenger data solely to confirm the presence of parameters related to deploying an airbag in a crash.

Consequently, a need still remains for an occupant status monitor that utilizes cross-technology sensors and sensor fusion to detect the presence of a person in a space, to determine the physical status of that person relative to the space, to provide a unique signal reflective of each status both locally and remotely, and to allow the person to forestall the activation of unwanted occupant status signals and to activate selected occupant status signals manually as a personal security and time management aid.

SUMMARY OF INVENTION

An occupant status monitor, according to the present invention, comprises three components. A detector, preferably utilizing passive infrared technology, senses the temperature range, size, shape, motion, time, and position of thermal energy in and relative to a space and transmits data concerning one or more of these parameters. A processor receives the data transmitted by the detector, compares the transmitted data with a predetermined data set representing attributes of a person or of the space, and transmits instructions based upon the results of the comparison. An indicator receives the instructions from the processor and activates signals showing whether a person is occupying or has occupied the space and the status of an occupant relative to the space.

In one embodiment, the processor instructs the indicator to activate a first occupant status signal when a person occupying the space is experiencing a possible physical emergency. The processor instructs the indicator to activate a second occupant status signal when a person occupying the space is not experiencing a possible physical emergency. The processor instructs the indicator to activate a third occupant status signal when a person has vacated the space briefly within a predetermined time period. The processor instructs the indicator not to activate a signal when no person is occupying the space during a time outside of the predetermined time period.

A variation of the second occupant status signal may be activated to show that the person occupying a given space is unwilling to be disturbed. A variation of the third occupant status signal may be activated to show when a person has vacated the space for a long duration during a predetermined time period.

Preferably, the processor is a microcomputer housed in a control module, which can also contain means for manually instructing the indicator to activate or deactivate occupant status signals and means for replicating the visual portion of those signals. Preferably, the indicator comprises a tone generator and an array of three lights. Typically, the three lights are red, amber, and green in color, where the red light and an audible tone are activated for the first occupant status signal, where the green light is activated for the second occupant status signal, where the amber light is activated for the third occupant status signal, and where no light or tone is activated for the fourth occupant status signal.

In one embodiment of the invention, activating occupant status signals is confined to the indicator. In yet another embodiment of the invention, activating occupant status signals is performed by a personal computer in the designated space using on-screen graphics and an internal tone generator. In yet another embodiment of the invention, the indicator shares activation of occupant status signals with a personal computer located in the space.

In one embodiment of the invention, the control module is a stand-alone component. In yet another embodiment of the invention, communications, processing and control functions are performed entirely by a personal computer located in the space.

In one embodiment of the invention, the control module or personal computer may be connected to a communications network, to allow for occupant status signals being activated at the immediate location to be replicated at remote locations by indicators and/or personal computers and/or illuminated panels linked to the same network and for occupant status signals being activated at remote locations to be replicated by the local indicator and/or personal computer. In yet another embodiment of the invention, personal computers that are connected to the same communications network may be used by a person to enter manual instructions for signals concerning his or her own status to be activated by the indicator and/or personal computer at his or her workstation while he or she is absent from the space.

Additionally, a concealed switch, connected to the control module or personal computer, may be used to send a silent alert to selected remote locations by means of a communications network.

In another aspect of the invention, the parameter detected by the detector is temperature and the predetermined data set includes a value representing a minimum temperature indicative of fire danger. Thus, when the temperature parameter data exceeds the predetermined data set value, the instruction sent by the processor will cause the indicator to activate the first occupant status signal as a fire alarm.

DETAILED DESCRIPTION

Figure 1:
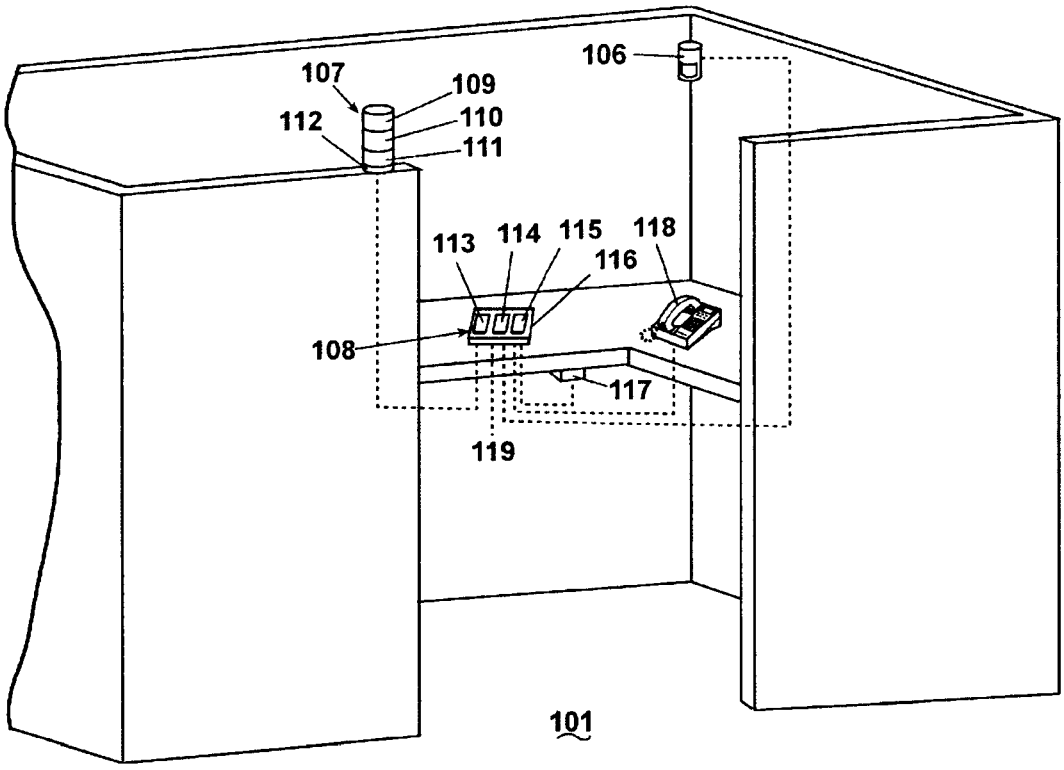
FIG. 1 is a front perspective view of a first embodiment of the present occupant status monitor installed in a representative, partially enclosed workstation.

A first embodiment of the present occupant status monitor is shown installed in typical, partially enclosed workstation 101 in FIG. 1. Detector 106, directed into space 101, and indicator 107, positioned in an easily visible location, such as on top of the wall of space 101, are connected to control module 108.

Detector 106 comprises one or more passive infrared receptors adapted to monitor the temperature range, size, shape, motion and position of thermal energy present in space 101 and transmit data relative to those parameters to control module 108.

Indicator 107 is preferably an audiovisual component that includes a first light 109, which is preferably red, a second light 110, which is preferably amber, a third light 111, which is preferably green, and a tone generator 112. Lights 109–111 are visible 360 degrees around indicator 107. It will be understood that activation of occupant status signals is not limited to indicator 107 but may be made by means of a personal computer screen in the immediate area or by means of similar indicators, personal computer screens or illuminated panels located remotely, such as on a wall in an entry room or at a receptionist's desk or anywhere on a communications network. Audio unit 112 of indicator 107 can supplement one or more visual displays or it can supplant the visual displays entirely for those who are visually impaired.

Control module 108 is primarily a microcomputer loaded with firmware, functioning as described hereafter. Control module 108 receives and monitors the time and duration of the raw data from the receptor or receptors in detector 106 regarding the temperature range, size, shape, motion and position of thermal energy detected in space 101 and ascertains by the process of sensor fusion whether the characteristics of those data indicate that a person is present; and, if so, determines whether he or she is in a normal state or is experiencing a possible physical emergency; and transmits instructions to activate a unique signal for each occupant status.

The sensing of the presence of thermal energy exhibiting the characteristics of a human body but exhibiting motion from an abnormal position or exhibiting no motion at all suggests that a person is present in space 101 and possibly in a state of physical emergency. The sensing of the presence of thermal energy exhibiting the characteristics of a human body and exhibiting motion from a normal position suggests that a person is present in space 101 and functioning normally. The subsequent sensing of the presence of no thermal energy exhibiting the characteristics of a human body in space 101 suggests that the occupant has vacated the space. Control module 108 sends indicator 107 instructions to activate each occupant status signal. Control module 108 includes a power switch 116 and may be connected to a concealed switch 117, located in an out-of-the-way place, such as under the desk, for sending a silent alert to one or more remote locations, sensor 118 for detecting when a telephone in the designated space is in use, and link 119 for connecting to a communications network.

Control module 108 also includes three illuminated buttons 113–115, which correspond in color to lights 109–111 of indicator 107 and operate in tandem with them. The illuminated buttons may each have a light and a switch that are combined into a single unit, or may feature a light and a switch as separate components. Depressing one of illuminated buttons 113–115 on control module 108 causes both the light associated with the button itself and corresponding light 109, 110 or 111 in indicator 107 to be activated simultaneously. Lights 109–111 and illuminated buttons 113–115 can be activated in either the constant or a flashing mode. For example, when green light 111 is activated in the constant mode, green illuminated button 115 is also activated in the constant mode, and when red light 109 is activated in a flashing mode, red illuminated button 113 is also activated in a flashing mode. The synchronized activation of illuminated buttons 113–115 of control module 108 with lights 109–111 of indicator 107 enables the person present in space 101 to confirm the operation of indicator 107 without having to look at it. Some exemplar statuses and their corresponding signals are as follows:

1. Present and experiencing a possible emergency: the red lights and a tone activated in an intermittent mode.
2. Present in a normal state and willing to be approached: the green lights activated in the constant mode.
3. Present in a normal state and wishing not to be disturbed: the green lights activated in a flashing mode.
4. Absent for a short period of time during a regular work shift: the amber lights activated in a flashing mode.
5. Absent for a long period of time during a regular work shift: the amber lights activated in the constant mode
6. Absent outside of a regular work shift: the activation of no visual or audio signal.

When the microcomputer in control module 108 ascertains from the data received from detector 106 that a person is present in space 101 and in a normal state, it instructs indicator 107 to activate green light 111 in indicator 107 and the green illuminated button 115 on control module 108 in the constant mode as a signal that the person is present and willing to be approached. If the microcomputer in control module 108 subsequently determines that the data transmitted by detector 106 reflects that a person is present in space 101 and is experiencing a possible physical emergency, it instructs indicator 107 to deactivate green light 111 and green illuminated button .115 and to activate red light 109 and red illuminated button 113 in a flashing mode and to sound the tone generator 112 intermittently as a signal of possible physical emergency.

If during a regular work shift the microcomputer in control module 108 determines from the data transmitted by detector 106 that the presence of thermal energy exhibiting the characteristics of a human body is no longer being sensed in space 101, it instructs indicator 107 to deactivate green light 111 and green illuminated button 115 and to activate amber light 110 and amber illuminated button 114 in a flashing mode as a signal that the person is absent for a short period of time. If the predetermined period of time allocated to short-term absences during a regular work shift elapses without detector 106 sensing in space 101 the presence of thermal energy exhibiting the characteristics of a human body, the microcomputer in control module 108 instructs indicator 107 to switch the activation of amber light 110 and amber illuminated button 114 from a flashing mode to the constant mode as a signal of long-term absence. When outside of a regular work shift the microcomputer in control module 108 determines from the data transmitted by detector 106 that the presence of no thermal energy exhibiting the characteristics of a human body is being sensed in space 101, it instructs indicator 107 to forego activation of lights or tone as a signal of prolonged absence unless and until a person is determined to be present in the space.

When the microcomputer in detector 108 receives notice from telephone sensor 118 that the telephone in space 101 is in use while green light 111 and green illuminated button 115 are activated in the constant mode, it instructs indicator 107 to switch the green lights from the constant mode to a flashing mode as a signal that the person is present but wishes not to be disturbed. When the microcomputer in detector 108 receives notice from telephone sensor 118 that the telephone in space 101 is no longer in use, it instructs indicator 107 to return activation of green light 111 and green illuminated button 115 to the constant mode as a signal that the person is present and willing to be approached.

The "Do Not Disturb," long-term absence and emergency signals and a command to reset the internal clock of the microcomputer in control module 108 may be activated manually by depressing the appropriate button or combination of buttons on control module 108. A silent alarm may be sent to one or more remote locations by use of concealed switch 117 connected to control module 108 should the person present in space 101 be threatened with harm. Occupant status signals may be sent to remote locations on a communications network via communications link 119 also connected to control module 108. Since the microcomputer in control module 108 is compatible with serial, parallel, USB, "Fire Wire," infrared and wireless connections and is capable of interfacing with personal computers under the control of all commonly installed operating systems, the occupant status monitor may be linked directly to any communications network and integrated with building security and environmental management systems.

Figure 2:
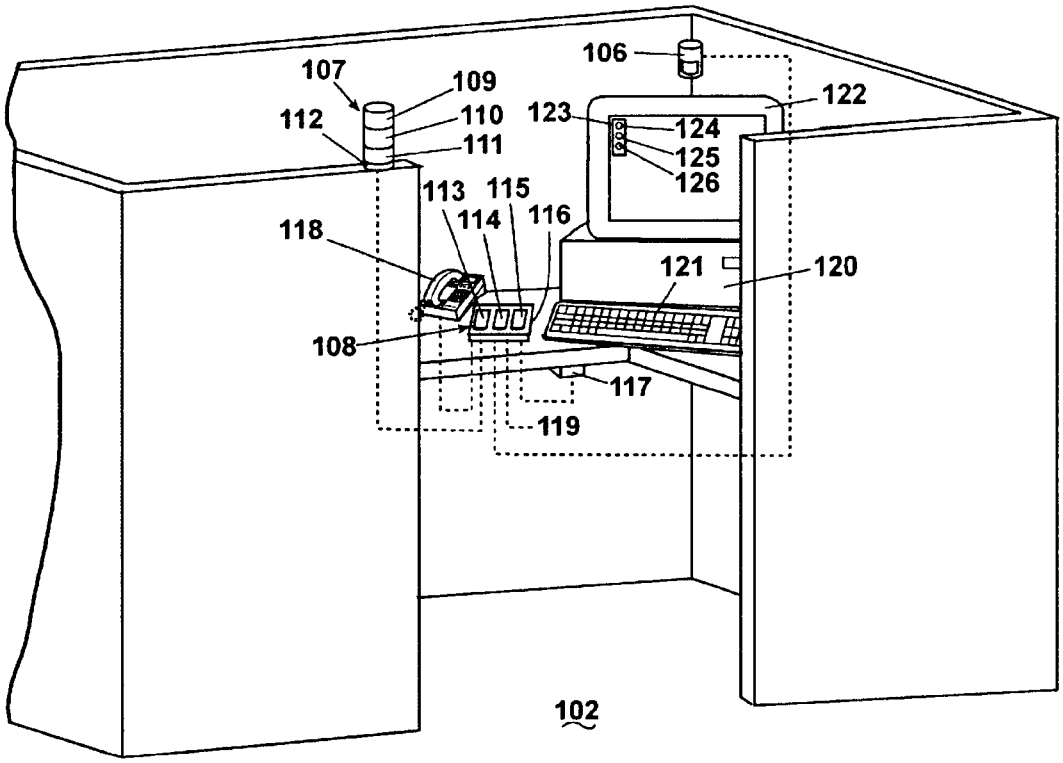
FIG. 2 is a front perspective view of a second embodiment thereof.

A second embodiment of the present occupant status monitor is shown installed in typical, partially enclosed workstation 102 in FIG. 2. As in the first embodiment in FIG. 1, detector 106, comprising an infrared receptor or receptors, directed into space 102 and indicator 107, housing red, amber and green lights 109–111 and tone generator 112, directed out of space 102 are connected to control module 108, which includes red, amber and green illuminated buttons 113–115, functioning in tandem with lights 109–111 of indicator 107, power switch 116, and connections to concealed switch 117, telephone use sensor 118, and communications link 119. In addition, personal computer 120, including keyboard 121 and screen 122, is connected to control module 108. As in the first embodiment, activation of occupant status signals by indicator 107 is accomplished automatically in response to instructions received from control module 108 based on data transmitted from detector 106 or manually by depressing one or more of illuminated buttons 113–115 associated with control module 108. In addition, occupant status signals may be represented as graphics on screen 122 of personal computer 120 utilizing lights 124–126 of icon 123, which correspond in color with lights 109–111 of indicator 107, and the computer's internal tone generator. In addition, keyboard 121 of personal computer 120 may be used to check on the occupant status signals being activated at other workstations, and, with the installation of any one of the readily available software applications designed for the purpose, to share notes and whereabouts messages with other workstations, such status signals, notes and messages being displayed on screen 122. If personal computer 120 is equipped with voice recognition, that feature may be used to check occupant status signals and to share notes and whereabouts messages by use of verbal commands.

Figure 3:
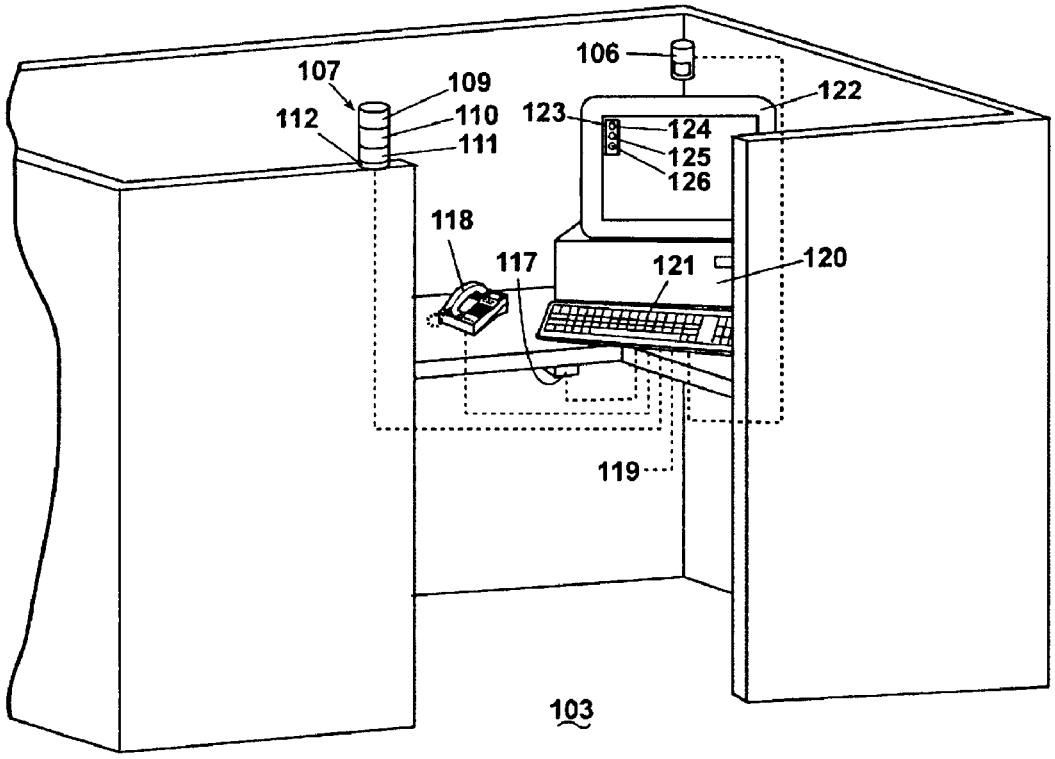
FIG. 3 is a front perspective view of a third embodiment thereof.

A third embodiment of the present occupant status monitor is shown installed in typical, partially enclosed workstation 103 in FIG. 3. Detector 106, indicator 107, concealed switch 117, telephone receiver sensor 118, and communications link 119 are all connected directly to personal computer 120, which includes keyboard 121 and screen 122. The control firmware is loaded into personal computer 120. As in FIG. 2, occupant status signals are implemented as graphics on screen 122 and the internal tone generator of personal computer 120 and/or by means of lights 109–111 and tone generator 112 in indicator 107. Occupant status signals are activated automatically as in the first two embodiments. Manual activation and deactivation of occupant status signals may be accomplished by depressing a combination of "hot keys" on keyboard 121:

The following combinations of hot keys represent one possible arrangement:

1. Simultaneously depressing the "Alt" and "J" keys activates and deactivates the emergency signal.
2. Simultaneously depressing the "Alt" and "K" keys activates and deactivates the "Do Not Disturb" signal.
3. Simultaneously depressing the "Alt" and "L" keys activates and deactivates the long-term absence signal.
4. Simultaneously depressing the "Alt," "K" and "L" activates the "Clock Reset" routine.

As in FIG. 2, keyboard 121 of personal computer 120 may be used to check on the occupant status signals being activated at other workstations, and, with the installation of any one of the readily available software applications designed for the purpose, to share notes and whereabouts messages with other workstations. In addition, a person may manually input instructions to the indicator or personal computer at his or her own workstation to activate signals pertaining to his or her own status from personal computers at remote locations if they are connected to a common communications network. As in FIG. 2, voice commands may be used to check the occupant status signals being activated at other workstations and to share notes and whereabouts messages if personal computer 120 has voice recognition capability.

Figure 4:
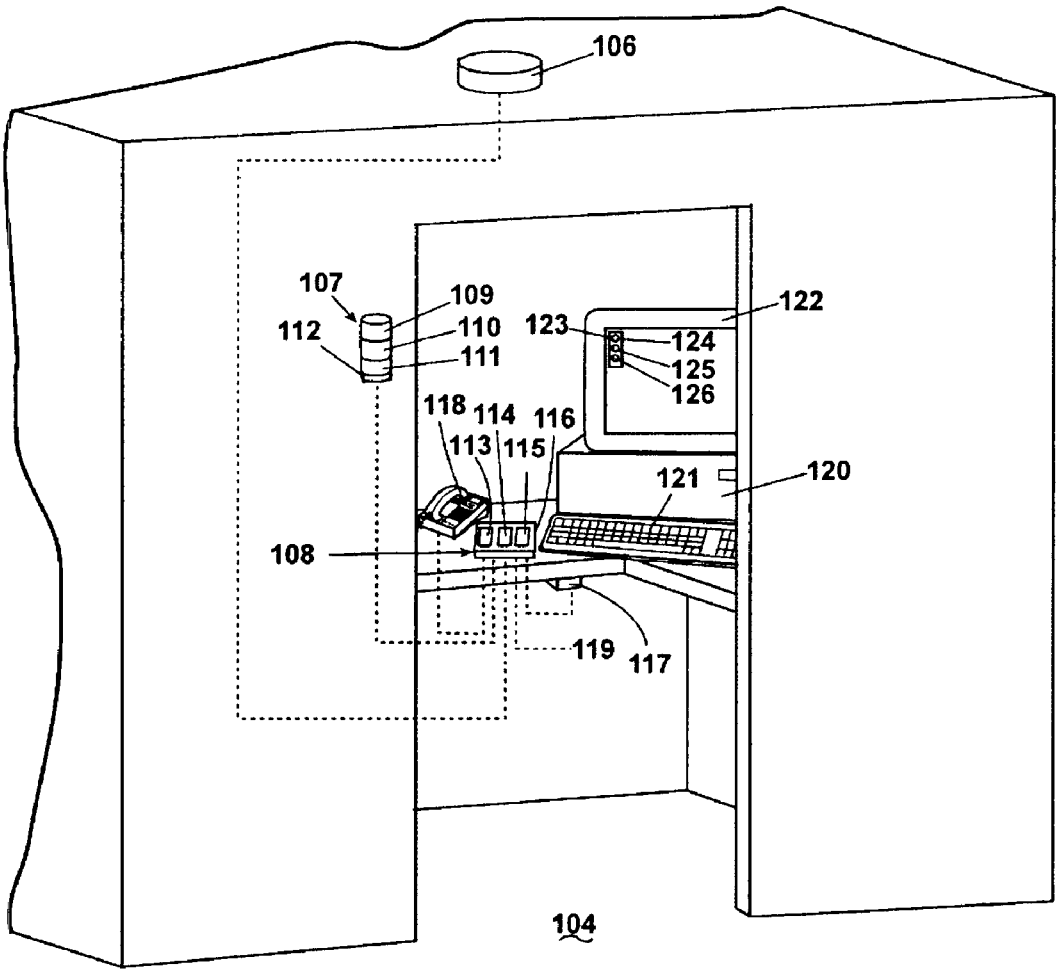
FIG. 4 is a front perspective view of a fourth embodiment of the present occupant status monitor installed in a representative, fully enclosed office.

A fourth embodiment of the present occupant status monitor is shown installed in a typical, fully enclosed office 104 in FIG. 4. The arrangement and function of components is identical to that of FIG. 2, except that detector 106 is mounted on the ceiling of office 104 and indicator 107 is mounted vertically on an exterior wall of office 104.

FIGS. 5A–5K present partial flowcharts of the firmware, which is loaded into the microcomputer of control module 108 of FIGS. 1, 2 and 4 or into the hard drive of personal computer 120 of FIG. 3. Upon powering up, the designated space is examined at step 1 of Main Routine A in FIG. 5A for the presence of thermal energy at or above the minimum temperature level indicative of possible fire danger. If the result is positive, a modulated tone is sounded at step 2 as a warning that the emergency alarm is about to be given. If the green button (or its personal computer equivalent) is not depressed at step 3, the program initiates Emergency Alarm Routine B in FIG. 5B. If the green button (or its personal computer equivalent) is depressed at step 3, activation of the emergency alarm is averted and a "wait state" is initiated at step 4 to allow time for eliminating the source of the possible fire danger. The "wait state" is continued until the green button (or its personal computer equivalent) is depressed at step 5, whereupon the program returns to step 1 to confirm that the source of the possible fire danger has been eliminated.

If the presence of thermal energy at or above the minimum temperature level indicative of possible fire danger is not sensed at step 1, the space is examined at step 6 for the presence of thermal energy failing within the normal temperature range of the human body. If the result is negative, the program returns to step 1. If the result is positive, the thermal energy is examined at steps 7 and 8 to determine whether its size and shape match normal human physical characteristics. If not, the program returns to step 1. If so, the program concludes that a person is present in the space and checks at step 9 to determine whether he or she is moving. If not, the program concludes that the person is experiencing a possible physical emergency and sounds a modulated tone at step 10 as a warning that the emergency alarm is about to be given. If the green button (or its personal computer equivalent) is not depressed at step 11, the program initiates Emergency Alarm Routine B in FIG. 5B. If the green button (or its personal computer equivalent) is depressed at step 11, activation of the emergency alarm is averted and the program returns to step 1. If at step 9 the person is found to be moving, a check is made at step 12 to determine whether he or she is situated in a normal position. If not, the program concludes that the person is experiencing a possible physical emergency and executes steps 10 and 11 as just described. If so, the program concludes that the person is in a normal state and advances to step 14, unless the green button (or its personal computer equivalent) is depressed at step 13 in order to advance to step 109 for activation of the visitor-present portion of Long-Term Absence Routine E in FIG. 5F.

At step 14 the green lights in the indicator and the control module are activated in the constant mode as a signal that a person is present in the space, that the occupant of the space is the one to whom it is officially assigned, and that he or she is in a normal state. At step 15 the space is examined for the presence of thermal energy at or above the minimum temperature level indicative of possible fire danger. If the result is positive, a modulated tone is sounded at step 16 as a warning that the emergency alarm is about to be given. If green button (or its personal computer equivalent) is not depressed at step 17, the green lights are deactivated at step 26 and the program initiates Emergency Alarm Routine B in FIG. 5B. If the green button (or its personal computer equivalent) is depressed at step 17, activation of the emergency alarm is averted and a "wait state" is initiated at step 18 to allow time for eliminating the source of the possible fire danger. The "wait state" is continued until the green button (or its personal computer equivalent) is depressed at step 19, whereupon the program returns to step 15 to confirm that the source of the possible fire danger has been eliminated.

If the presence of thermal energy at or above the level indicative of possible fire danger is not sensed at step 15, the program advances to step 20, where the space is examined for the continued presence of thermal energy falling within the normal temperature range of a human body. If the result is negative, the program concludes that the person has vacated the space. Consequently, the green lights are deactivated at step 21 and a time check is made at step 22. If the current time is found to fall within a regular work shift, the program concludes that the person will be absent for a short period of time and initiates Short-Term Absence Routine C in FIG. 5D. Otherwise, it returns to step 1. If the continued presence of thermal energy falling within the normal temperature range of a human body is sensed at step 20, the program concludes that the person is still present in the space and makes a check at step 23 to determine whether the he or she is moving. If not, the program concludes that the person is experiencing a possible physical emergency and sounds a modulated tone at step 24 as a warning that the emergency alarm is about to be given. If the green button (or its personal computer equivalent) is not depressed at step 25, the green lights are deactivated at step 26 and the program initiates Emergency Alarm Routine B in FIG. 5B. If the green button (or its personal computer equivalent) is depressed at step 25, activation of the emergency alarm is averted and the program concludes that the person is in a normal state and advances to step 28. If at step 23 the person is found to be moving, a check is made at step 27 to determine whether he or she is situated in a normal position. If not, the program concludes that the person is experiencing a possible physical emergency and executes steps 24 and 25 as just described. Otherwise, it concludes that the person is in a normal state and advances to step 28.

Figure 5A:
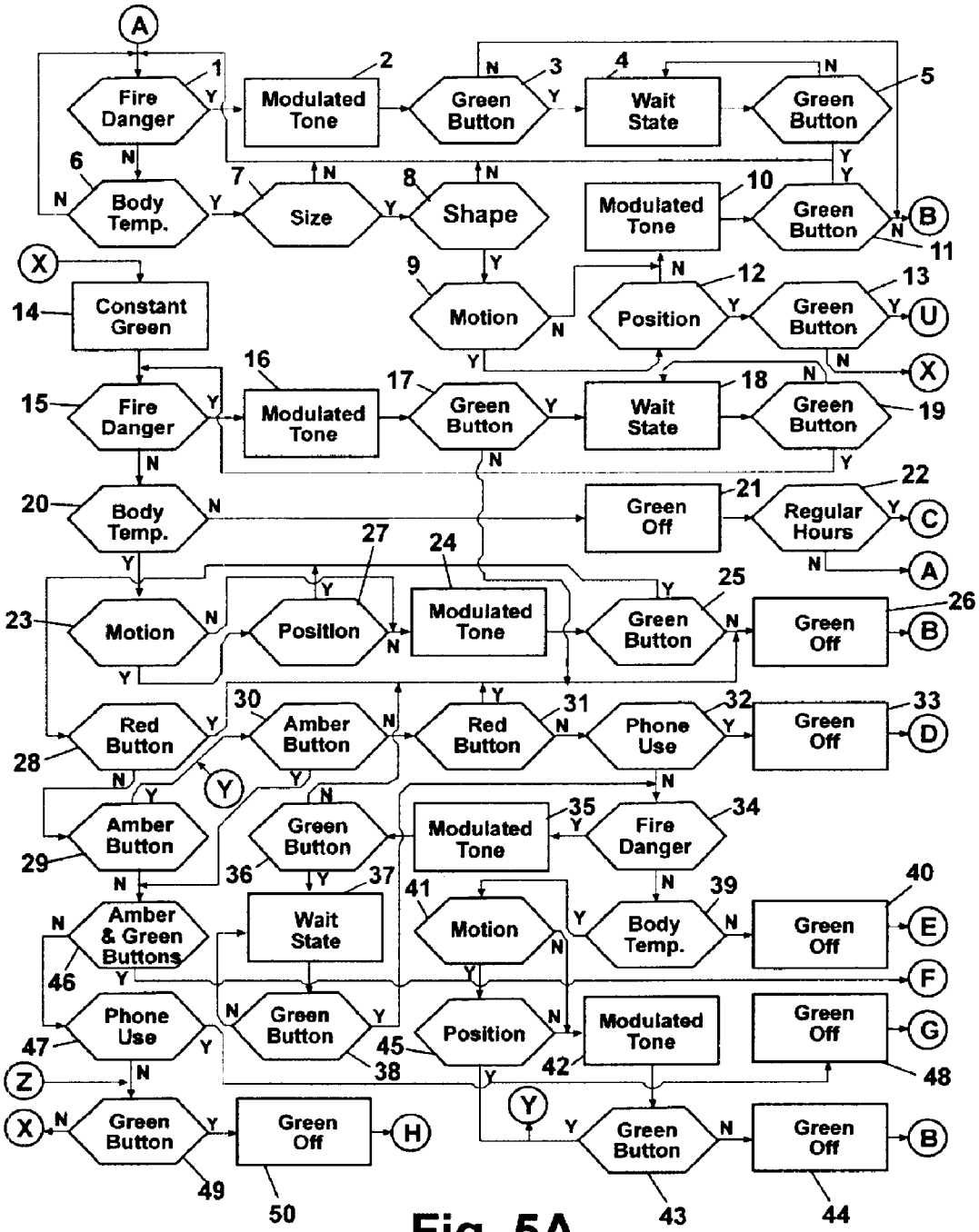
FIGS. 5A–5K present partial flowcharts of the control firmware for the embodiments depicted in FIGS. 1–4.
Figure 5B:
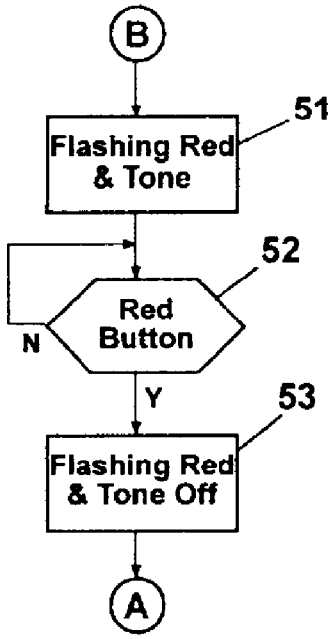

At step 28 the red button (or its personal computer equivalent) may be depressed to deactivate the green lights at step 26 and initiate Emergency Alarm Routine B in FIG. 5B. Otherwise, the amber button (or its personal computer equivalent) may be depressed at step 29 to begin the process of initiating the long-term absence routine. During this process, the amber button (or its personal computer equivalent) may be depressed at step 30 to cancel initiation of the long-term absence routine and advance to step 46 or the red button (or its personal computer equivalent) may be depressed at step 31 to deactivate of the green lights at step 26 and initiate Emergency Alarm Routine B in FIG. 5B. Otherwise, a check is made at step 32 for telephone use in the space. If the result is positive, the green lights are deactivated at step 33 and the program initiates Telephone Use Routine D in FIG. 5E. If no telephone use is sensed at step 32, a check is made at step 34 for the presence of thermal energy at or above the minimum temperature level indicative of possible fire danger. If the result is positive, a modulated tone is sounded at step 35 as a warning that the emergency alarm is about to be given. If the green button (or its personal computer equivalent) is not depressed at step 36, the green lights are deactivated at step 26 and the program initiates Emergency Alarm Routine B in FIG. 5B. If the green button (or its personal computer equivalent) is depressed at step 36, activation of the emergency alarm is averted and a "wait state" is initiated at step 37 to allow time for eliminating the source of the possible fire danger. The "wait state" is continued until the green button (or its personal computer equivalent) is depressed at step 38, whereupon the program returns to step 34 to confirm that the source of the possible fire danger has been eliminated.

If the presence of thermal energy at or above the minimum temperature level indicative of possible fire danger is not sensed at step 34, a check is made at step 39 for the continued presence of thermal energy falling within the normal temperature range of a human body. If the result is negative, the program concludes that the person has vacated the space. Consequently, the green lights are deactivated at step 40 and the program initiates Long-Term Absence Routine E in FIGS. 5F and 5G. If the result is positive, a check is made at step 41 to determine whether the person is moving. If not, the program concludes that he or she is experiencing a possible physical emergency and sounds a modulated tone at step 42 as a warning that the emergency alarm is about to be given. If the green button (or its personal computer equivalent) is not depressed at step 43, the green lights are deactivated at step 44 and the program initiates Emergency Alarm Routine B in FIG. 5B. If the green button (or its personal computer equivalent) is depressed at step 43, activation of the emergency alarm is averted and the program concludes that the person is in a normal state and returns to step 30 to continue the process of initiating the Long-Term Absence Routine. If at step 41 the person is found to be moving, a check is made at step 45 to determine whether he or she is situated in a normal position. If not, the program concludes that the person is experiencing a possible physical emergency and executes steps 42 and 43 as just described. If so, it concludes that the person is in a normal state and returns to step 30 to continue the process of initiating the Long-Term Absence Routine.

Figure 5C:
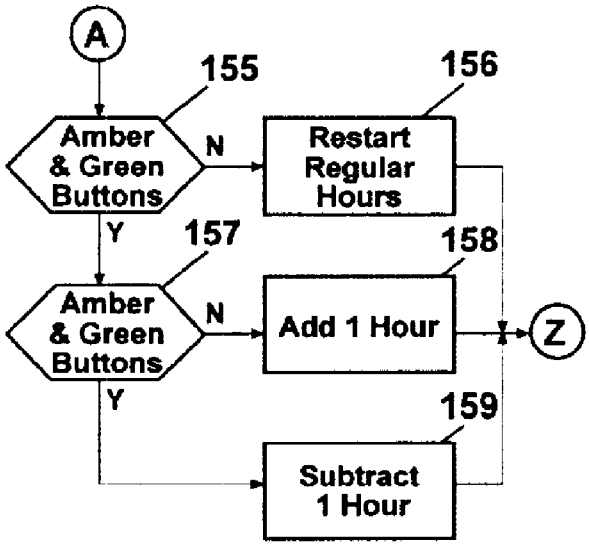
Figure 5D:
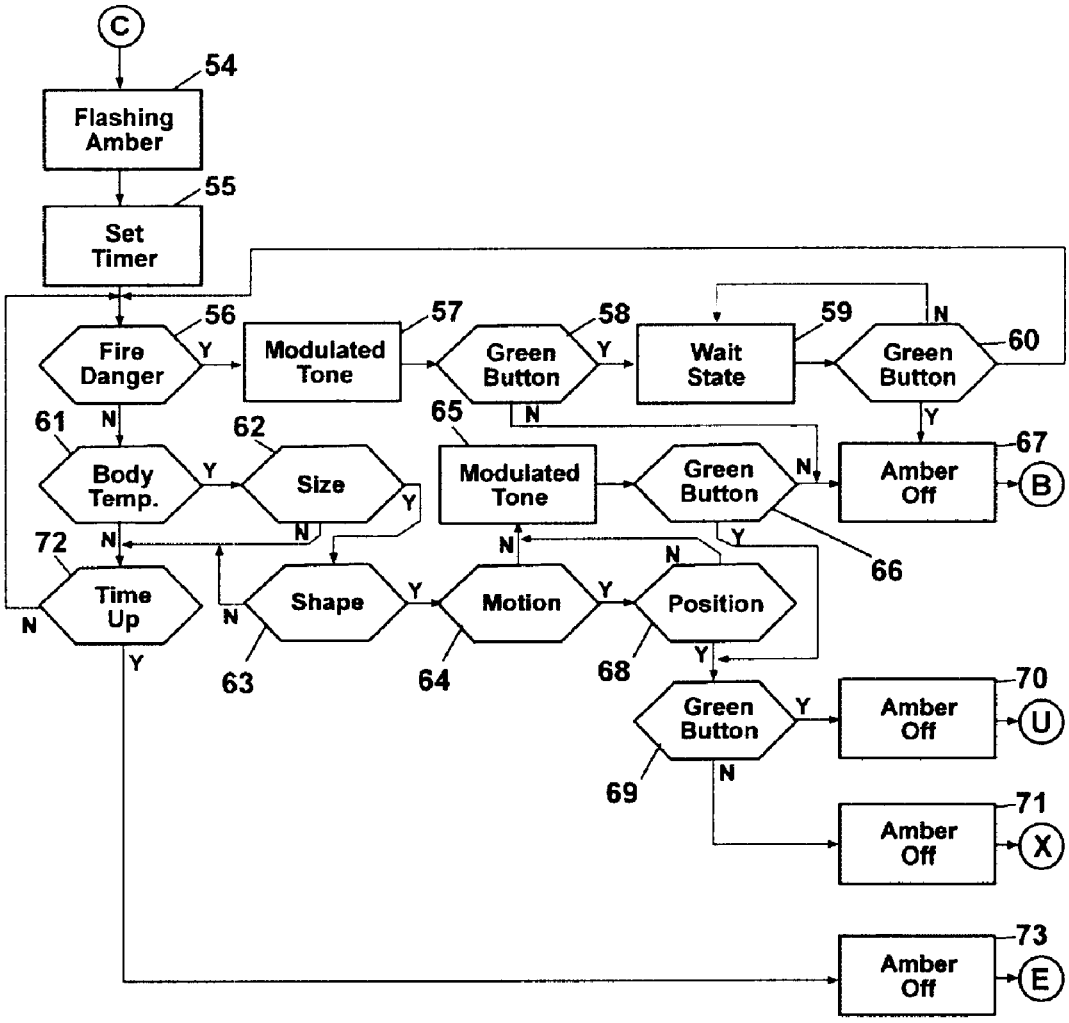

If the amber button (or its personal computer equivalent) is not depressed at step 29, the amber and green buttons (or their personal computer equivalents) may be depressed simultaneously at step 46 to initiate Clock Reset Routine F in FIG. 5C. Otherwise, a check is made at step 47 for telephone use. If the result is positive, the green lights are deactivated at step 48 and the program initiates Telephone Use Routine G in FIG. 5H. If telephone use is not sensed at step 47, the green button (or its personal computer equivalent) may be depressed at step 49 to deactivate the green lights in the constant mode at step 50 and initiate "Do Not Disturb" Routine H in FIG. 51. Otherwise, the program returns to step 14 to continue the main routine.

When Emergency Alarm Routine B in FIG. 5B is initiated, the red lights in the indicator and control module are activated in a flashing mode at step 51 and the tone generator is sounded intermittently. This audio-visual alarm is continued until the red button (or its personal computer equivalent) is depressed at step 52, whereupon the flashing red lights and the intermittent tone generator are deactivated at step 53 and the program returns to step 1 of Main Routine A in FIG. 5A. The emergency alarm may be sent to one or more selected locations via a link to a communications network.

When Short-term Absence Routine C in FIG. 5C is initiated, the amber lights in the indicator and control module are activated in a flashing mode at step 54 as a signal that the person is absent from the space for a short period and the internal timer is set for a predetermined amount of time at step 55. The space is then examined at step 56 for the presence of thermal energy at or above the minimum temperature level indicative of possible fire danger. If the result is positive, a modulated tone is sounded at step 57 as a warning that the emergency alarm is about to be given. If the green button (or its personal computer equivalent) is not depressed at step 58, the amber lights are deactivated at step 67 and the program initiates Emergency Alarm Routine B in FIG. 5B. If the green button (or its personal computer equivalent) is depressed at step 58, activation of the emergency alarm is averted and a "wait state" is initiated at step 59 to allow time for eliminating the source of the possible fire danger. The "wait state" is continued until the green button (or its personal computer equivalent) is depressed at step 60, whereupon the program returns to step 56 to confirm that the source of the possible fire danger has been eliminated.

If at step 56 the presence of thermal energy at or above the minimum temperature level indicative of possible fire danger is not sensed, the space is examined at step 61 for the presence of thermal energy falling within the normal temperature range of the human body. If the result is positive, the thermal energy is examined at steps 62 and 63 to determine whether its size and shape match normal human physical characteristics. If so, the program concludes that a person is now present in the space and makes a check at step 64 to determine whether he or she is moving. If not, the program concludes that the person is experiencing a possible emergency and sounds a modulated tone at step 65 as a warning that the emergency alarm is about to be given. If the green button (or its personal computer equivalent) is not depressed at step 66, the amber lights are deactivated at step 67 and the program initiates Emergency Alarm Routine B in FIG. 5B. If the green button (or its personal computer equivalent) is depressed at step 66, activation of the emergency alarm is averted and the program concludes that the person now present in the space is in a normal state and advances to step 69. If the person now present in the space is a visitor, the green button (or its personal computer equivalent) may be depressed at step 69 in order to deactivate the flashing amber lights at step 70 and advance to step 109 for activation of the visitor-present portion of Long-Term Absence Routine E in FIG. 5F. If the person now present in the space is the one to whom it is officially assigned, not depressing the green button (or its personal computer equivalent) at step 69 will deactivate the flashing amber lights at step 71 and return the program to step 14 of Main Routine A in FIG. 5A.

If at step 64 the person now present in the space is found to be moving, a check is made at step 68 to determine whether he or she is situated in a normal position. If not, the program concludes that the person is experiencing a possible physical emergency and steps 65 and 66 are executed as previously described. Otherwise, the program concludes that a person is present in the space and is in a normal state and advances to step 69, for exercise of the options just described. If the presence of thermal energy falling within the normal temperature range of the human body is not sensed at step 61, the program concludes that the person has not returned to the space and makes a time check at step 72. If the amount of time allocated for short-term absences is found to have expired, the flashing amber lights are deactivated at step 73 and the program initiates Long-Term Absence Routine E in FIGS. 5F and 5G. Otherwise, the program returns to step 56 to continue the short-term absence routine.

Figure 5E:
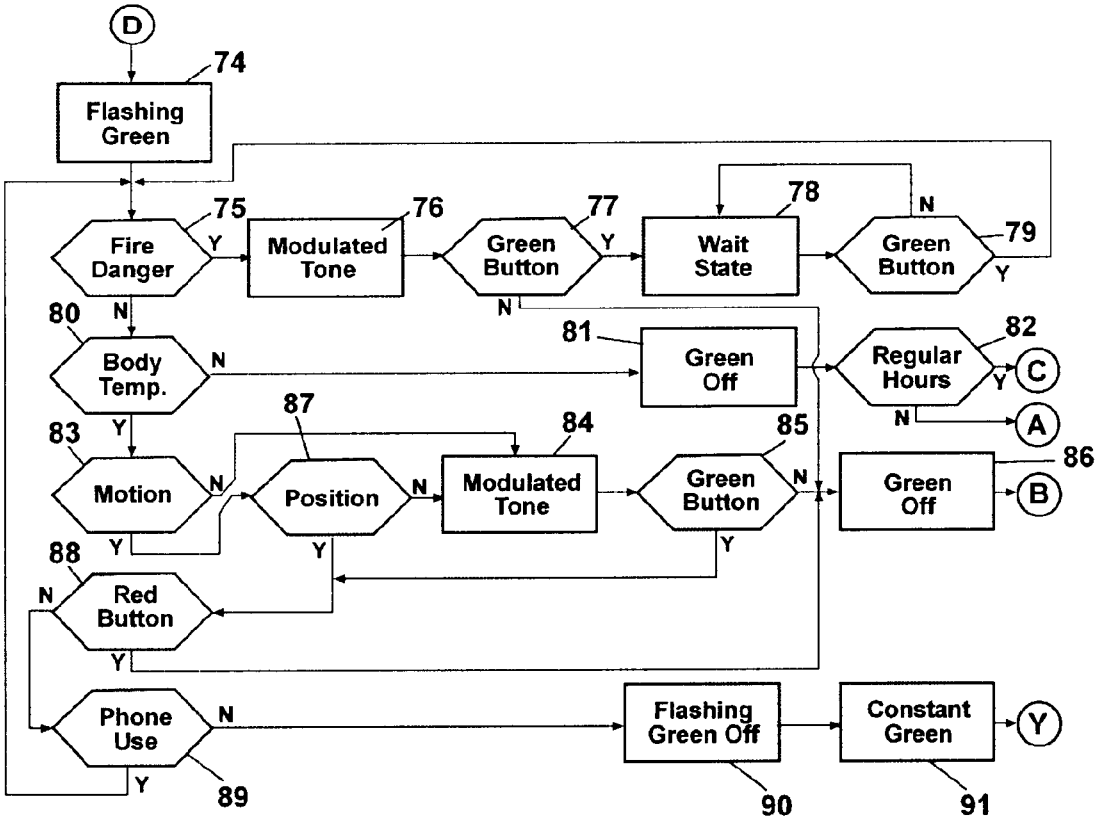

When Telephone Use Routine D in FIG. 5E is initiated, the green lights are activated in a flashing mode at step 74 as a "Do Not Disturb" signal. The space is then examined at step 75 for the presence of thermal energy at or above the minimum temperature level indicative of possible fire danger. If the result is positive, a modulated tone is sounded at step 76 as a warning that the emergency alarm is about to be given. If the green button (or its personal computer equivalent) is not depressed at step 77, the green lights are deactivated at step 86 and the program initiates Emergency Alarm Routine B in FIG. 5B. If the green button (or its personal computer equivalent) is depressed at step 77, a "wait state" is initiated at step 78 to allow time for eliminating the source of the possible fire danger. The "wait state" is continued until the green button (or its personal computer equivalent) is depressed at step 79, whereupon the program returns to step 75 to confirm that the source of the possible fire danger has been eliminated.

If the presence of thermal energy at or above the minimum temperature level indicative of possible fire danger is not sensed at step 75, the space is examined at step 80 for the continued presence of thermal energy falling within the normal temperature range of the human body. If the result is negative, the program concludes that the person has vacated the space. Consequently, the flashing green lights are deactivated at step 81 and a time check is made at step 82. If the current time is found to fall within a regular work shift, the program initiates Short-Term Absence Routine C in FIG. 5D. Otherwise, it returns to step 1 of Main Routine A in FIG. 5A. If the continued presence of thermal energy falling within the normal temperature range of a human body is sensed at step 80, the program concludes that the person is still present in the space and makes a check at step 83 to determine whether he or she is moving. If not, the program concludes that the person is experiencing a possible physical emergency and sounds a modulated tone at step 84 as a warning that the emergency alarm is about to be given. If the green button (or its personal computer equivalent) is not depressed at step 85, the flashing green lights are deactivated at step 86 and the program initiates Emergency Alarm Routine B in FIG. 5B. If the green button (or its personal computer equivalent) is depressed at step 85, activation of the emergency alarm is averted and the program concludes that the person is in a normal state and advances to step 88. If at step 83 the person is found to be moving, a check is made at step 87 to determine whether he or she is situated in a normal position. If not, the program concludes that the person is experiencing a possible physical emergency and executes steps 84 and 85 as just described. If so, the program concludes that the person is in a normal state and advances to step 88.

At step 88 the red button (or its personal computer equivalent) may be depressed to deactivate the flashing green lights at step 86 and initiate Emergency Alarm Routine B in FIG. 5B. If the red button (or its personal computer equivalent) is not depressed at step 88, a check for continued telephone use is made at step 89. If the result is negative, the flashing green lights are deactivated at step 90, and reactivated in the constant mode at step 91, and the program returns to step 30 of Main Routine A in FIG. 5A to continue the process of initiating the long-term absence routine. Otherwise, it returns to step 75 to continue the telephone use routine.

Figure 5F:
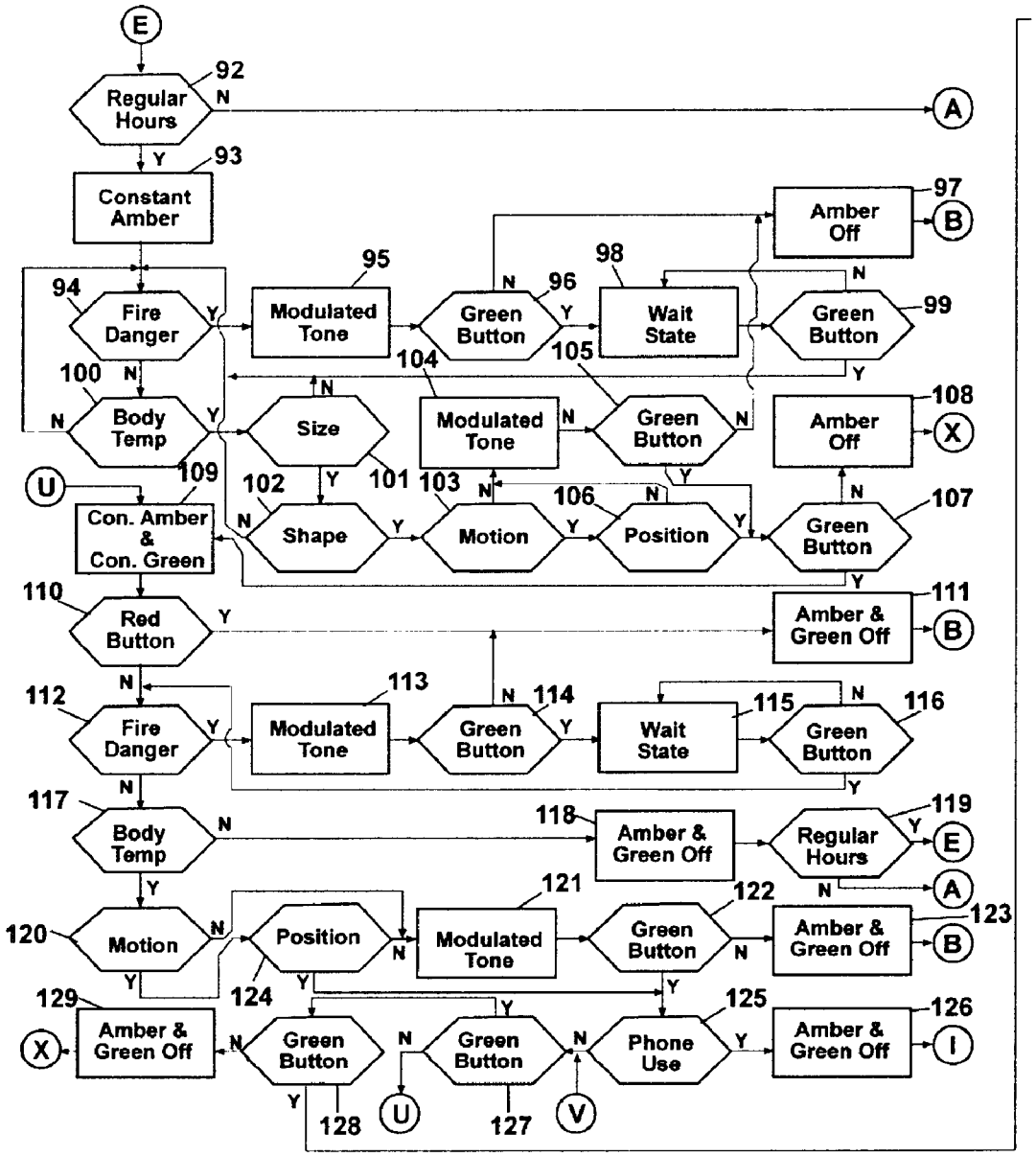
Figure 5G:
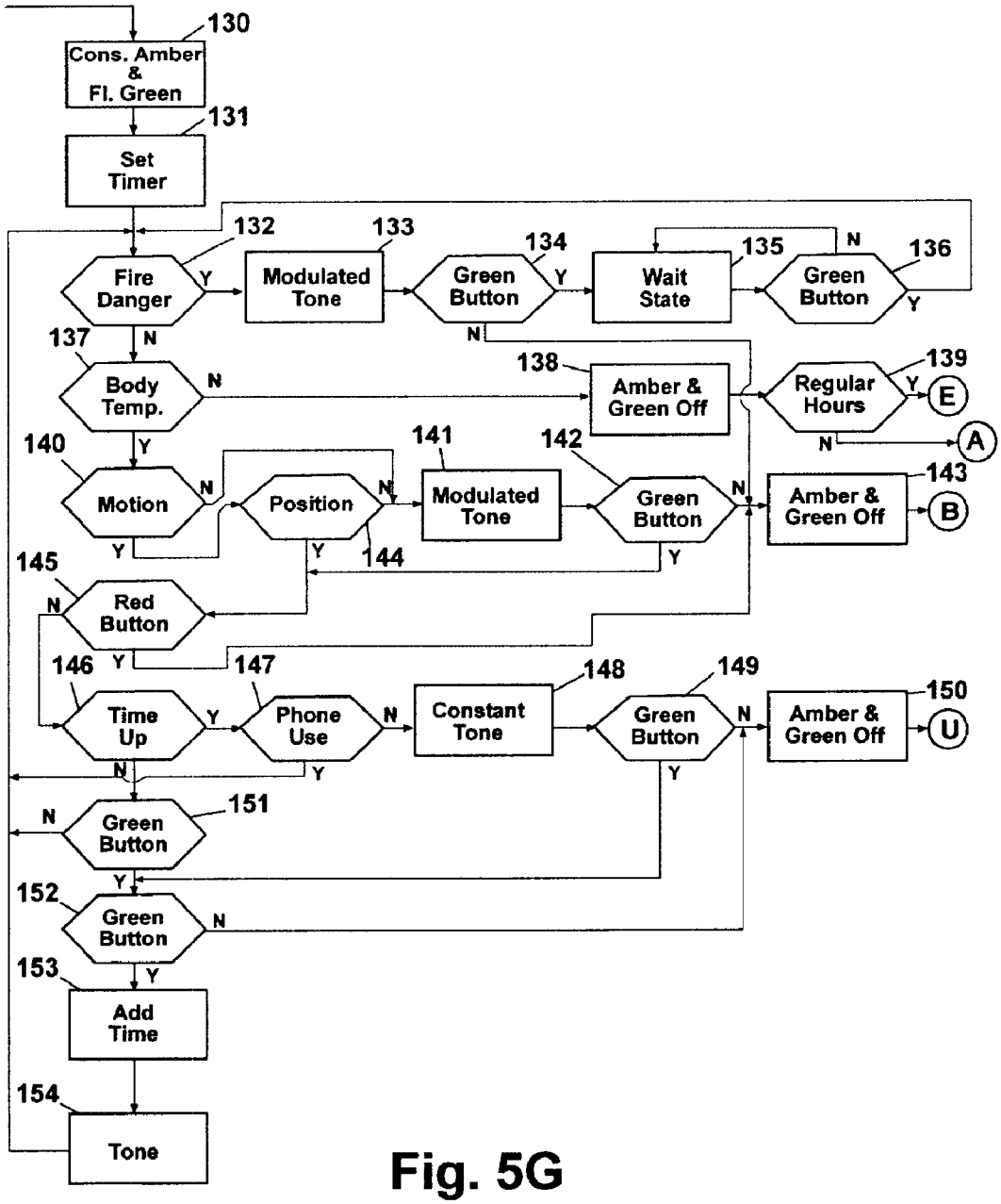

When Long-Term Absence Routine E in FIGS. 5F and 5G is initiated, a time check is made at step 92. If the current time is found to fall outside of a regular work shift, the program returns to step 1 of Main Routine A in FIG. 5A. Otherwise, it activates the amber lights in the constant mode at step 93 as a signal of long-term absence and checks the space at step 94 for the presence of thermal energy at or above the minimum temperature level indicative of possible fire danger. If the result is positive, a modulated tone is sounded at step 95 as a warning that the emergency alarm is about to be given. If the green button (or its personal computer equivalent) is not depressed at step 96, the constant amber lights are deactivated at step 97 and the program initiates Emergency Alarm Routine B in FIG. 5B. If the green button (or its personal computer equivalent) is depressed at step 96, a "wait state" is initiated at step 98 to allow time for eliminating the source of the possible fire danger. The "wait state" is continued until the green button (or its personal computer equivalent) is depressed at step 99, whereupon the program returns to step 94 to confirm that the source of the possible fire danger has been eliminated.

If the presence of thermal energy at or above the minimum temperature level indicative of possible fire danger is not sensed at step 94, the space is examined at step 100 for the presence of thermal energy falling within the normal temperature range of the human body. If the result is negative, the program concludes that the person is still absent from the space and returns to step 94. Otherwise, the thermal energy is examined at steps 101 and 102 to determine whether its size and shape match normal human physical characteristics. If not, the program concludes that the person is still absent from the space and returns to step 94. If so, the program concludes that a person is now present in the space and makes a check at step 103 to determine whether he or she is moving. If not, a modulated tone is sounded at step 104 as a warning that the emergency alarm is about to be given. If the green button (or its personal computer equivalent) is not depressed at step 105, the constant amber lights are deactivated at step 97 and the program initiates Emergency Alarm Routine B in FIG. 5B. If the green button (or its personal computer equivalent) is depressed at step 105, activation of the emergency alarm is averted and the program concludes that the person now present in the space is in a normal state and advances to step 107. If the person now present in the space is the one to whom it is officially assigned, not depressing the green button (or its personal computer equivalent) at step 107 will deactivate the constant amber lights at step 108 and return the program to step 14 of Main Routine A in FIG. 5A. If person now present in the space is a visitor, depressing the green button (or its personal computer equivalent) at step 107 will advance the program to step 109, where both the amber lights and the green light will be activated simultaneously in the constant mode as a signal that the person now present in the space is a visitor and that he or she is in a normal state. If at step 103 the person is found to be moving, a check is made at step 106 to determine whether he or she is situated in a normal position. If not, the program concludes that the person is experiencing a possible physical emergency and executes steps 104 and 105 as just described. If so, the program advances to step 107 for the options just described.

After the amber and green lights have been simultaneously activated in the constant mode at step 109, the red button (or its personal computer equivalent) may be depressed at step 110 to deactivate them at step 111 and initiate Emergency Alarm Routine B in FIG. 5B. If the red button (or its personal computer equivalent) is not depressed at step 110, the space is examined at step 112 for the presence of thermal energy at or above the minimum temperature level indicative of possible fire danger. If the result is positive, a modulated tone is sounded at step 113 as a warning that the emergency alarm is about to be given. If the green button (or its personal computer equivalent) is not depressed at step 114, the constant amber and green lights are deactivated at step 111 and the program initiates Emergency Alarm Routine B in FIG. 5B. If the green button (or its personal computer equivalent) is depressed at step 114, activation of the emergency alarm is averted and a "wait state" is initiated at step 115 to allow time for eliminating the source of the possible fire danger. The "wait state" is continued until the green button (or its personal computer equivalent) is depressed at step 116, whereupon the program returns to step 112 to confirm that the source of the possible fire danger has been eliminated.

If the presence of thermal energy at or above the minimum temperature level indicative of possible fire danger is not sensed at step 112, the space is examined at step 117 for the continued presence of thermal energy falling within the normal temperature range of a human body. If the result is negative, the program concludes that the visitor has vacated the space. Consequently, the constant amber and green lights are deactivated at step 118 and a time check is made at step 119. If the current time is found to fall within a regular work shift, the program returns to step 92. Otherwise, it returns to step 1 of Main Routine A in FIG. 5A. If the result of the temperature check made at step 117 is positive, the program concludes that the visitor is still present in the space and makes a check at step 120 to determine whether he or she is moving. If not, the program concludes that the visitor is experiencing a possible physical emergency and sounds a modulated tone at step 121 as a warning that the emergency alarm is about to be given. If the green button (or its personal computer equivalent) is not depressed at step 122, the constant amber and green lights are deactivated at step 123 and the program initiates Emergency Alarm Routine B in FIG. 5B. If the green button (or its personal computer equivalent) is depressed at step 122, activation of the emergency alarm is averted and the program concludes that the visitor is in a normal state and advances to step 125. If at step 120 the visitor is found to be moving, a check is made at step 124 to determine whether he or she is situated in a normal position. If not, the program concludes that the visitor is experiencing a possible physical emergency and executes steps 121 and 122 as just described. If so, the program concludes that the visitor is in a normal state and advances to step 125.

At step 125, a check is made for telephone use. If the result is positive, the constant amber and green lights are deactivated at step 126 and the program initiates Telephone Use Routine I in FIG. 5J. If no telephone use is sensed at step 125 and the green button (or its personal computer equivalent) is not depressed at step 127, the program returns to step 109 to continue the visitor-present portion of the long-term absence routine. If the green button (or its personal computer equivalent) is depressed at step 127 and immediately depressed again at step 128, the program advances to step 130 for initiation of a visitor-present "Do Not Disturb" period. If the green button (or its personal computer equivalent) is depressed at step 127 and not immediately depressed again at step 128, the constant amber and green lights are deactivated at step 129 and the program returns to step 14 of Main Routine A in FIG. 5A, where the green lights are activated in the constant mode as a signal that the person now present in the space is the one to whom it is officially assigned and that he or she is in a normal state.

When a visitor-present "Do Not Disturb" period is initiated, the green lights are activated in flashing mode at step 130 in FIG. 5G, while the amber lights are simultaneously activated in the constant mode. The internal timer is then set at step 131 for a predetermined amount of time and the space is examined at step 132 for the presence of thermal energy at or above the minimum temperature level indicative of possible fire danger. If the result is positive, a modulated tone is sounded at step 133 as a warning that the emergency alarm is about to be given. If the green button (or its personal computer equivalent) is not depressed at step 134, the constant amber and flashing green lights are deactivated at step 143 and the program initiates Emergency Alarm Routine B in FIG. 5B. If the green button (or its personal computer equivalent) is depressed at step 134, a "wait state" is initiated at step 135 to allow time for eliminating the source of the possible fire danger. The "wait state" is continued until the green button (or its personal computer equivalent) is depressed at step 136, whereupon the program returns to step 132 to confirm that the source of the possible fire danger has been eliminated.

If the presence of thermal energy at or above the minimum temperature level indicative of possible fire danger is not sensed at step 132 , a check is made at step 137 for the presence of thermal energy falling within the normal temperature range of a human body. If the result is negative, the program concludes that the visitor has vacated the space. Consequently, the constant amber and flashing green lights are deactivated at step 138 and a time check is made at step 139. If the current time is found to fall within a regular work shift, the program returns to step 92 to resume the owner-absent portion of the long-term absence routine. Otherwise, it returns to step 1 of Main Routine A in FIG. 5A. If the presence of thermal energy falling within the normal temperature range of a human body is sensed at step 137, the program concludes that the visitor is still present in the space and makes a check at step 140 to determine whether he or she is moving. If not, the program concludes that the visitor is experiencing a possible physical emergency and sounds a modulated tone at step 141 as a warning that the emergency alarm is about to be given. If the green button (or its personal computer equivalent) is not depressed at step 142, the constant amber and flashing green lights are deactivated at step 143 and the program initiates Emergency Alarm Routine B in FIG. 5B. If the green button (or its personal computer equivalent) is depressed at step 142, activation of the emergency alarm is averted and the program concludes that the visitor is in a normal state and advances to step 145. If at step 140 the visitor is found to be moving, a check is made at step 144 to determine whether he or she is situated in a normal position. If not, the program concludes that the visitor is experiencing a possible physical emergency and executes steps 142 and 143 as just described. Otherwise, it concludes that the visitor is in a normal state and advances to step 145.

At step 145 the red button (or its personal computer equivalent) may be depressed to deactivate the constant amber and flashing green lights at step 143 and initiate Emergency Alarm Routine B in FIG. 5B. Otherwise, a check is made at step 146 to determine whether the amount of time allocated for the visitor-present "Do Not Disturb" period has expired. If so, a check is made for telephone use at step 147. If the result is positive, the program returns to step 132 to continue the visitor-present "Do Not Disturb" period. Otherwise, a constant tone is sounded at step 148 as a warning that the "Do Not Disturb" period is about to end. The green button (or its personal computer equivalent) may then be depressed at step 149 to extend the "Do Not Disturb" period as described below. Otherwise, the constant amber and flashing green lights are deactivated at step 150 and the program returns to step 109 to resume the visitor-present portion of Long-Term Absence Routine E in FIG. 5F. If at step 146 the amount of time allocated to the "Do Not Disturb" period is found not to have expired, the program advances to step 151, where the "Do Not Disturb" period may be allowed to run its course by taking no action. Alternatively, it may be ended or extended. If the green button (or its personal computer equivalent) is depressed at step 151 and not immediately depressed again at step 152, the constant amber and flashing green lights are deactivated at step 150 and the program returns to step 109 in the visitor-present portion of Long-Term Absence Routine E in FIG. 5F. If the green button (or its personal computer equivalent) is depressed at step 151 and immediately depressed again at step 152, a predetermined amount of time is added to the timer at 153, a confirming tone is sounded at step 154, and the program returns to step 132 to continue the visitor-present portion of the "Do Not Disturb" subroutine.

When Clock Reset Routine F shown in FIG. 5C is initiated and the amber and green buttons (or their computer equivalents) are not depressed simultaneously at step 155, the internal clock is adjusted at step 156 to recognize the current time as the beginning of a regular work shift. If the amber and green buttons (or their computer equivalents) are depressed simultaneously at step 155, and not immediately depressed again at step 157, one hour is added to the internal clock at step 158. If the amber and green buttons (or their personal computer equivalents) are depressed simultaneously at step 155 and immediately depressed again at step 157, one hour is subtracted from the internal clock at step 159. After the internal clock has been reset at either step 156 or 158 or 159, the program returns to step 49 of Main Routine A in FIG. 5A.

Figure 5H:
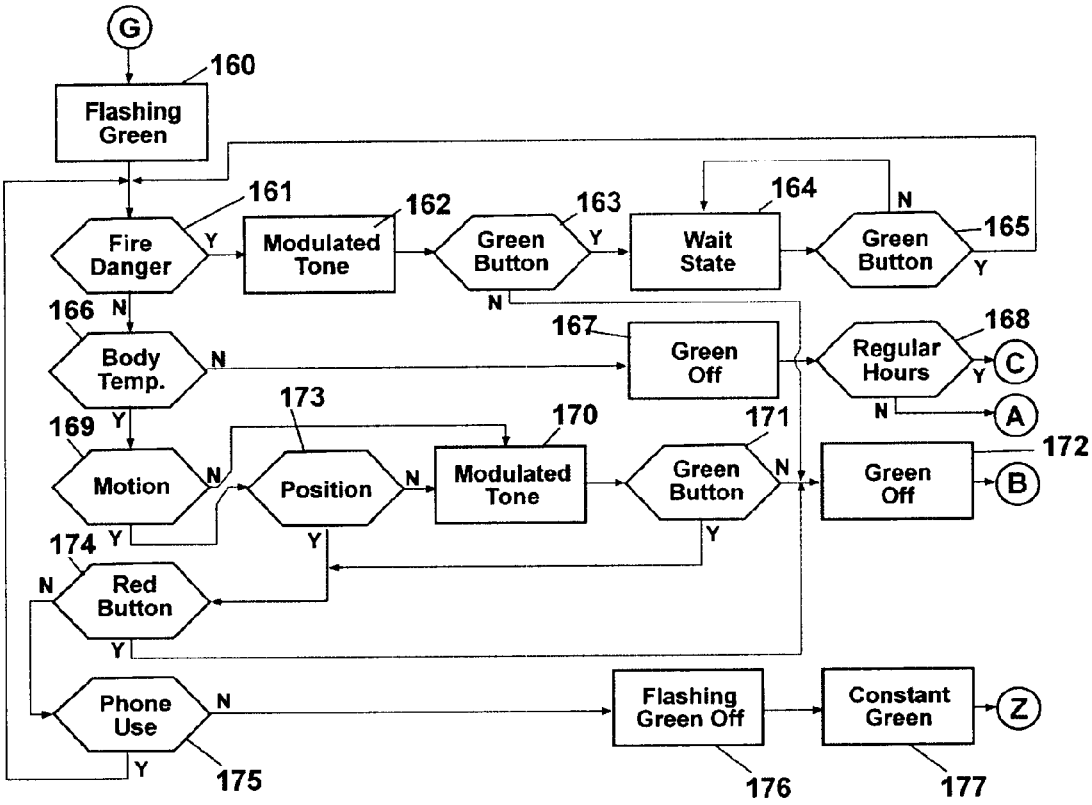
Figure 5L:
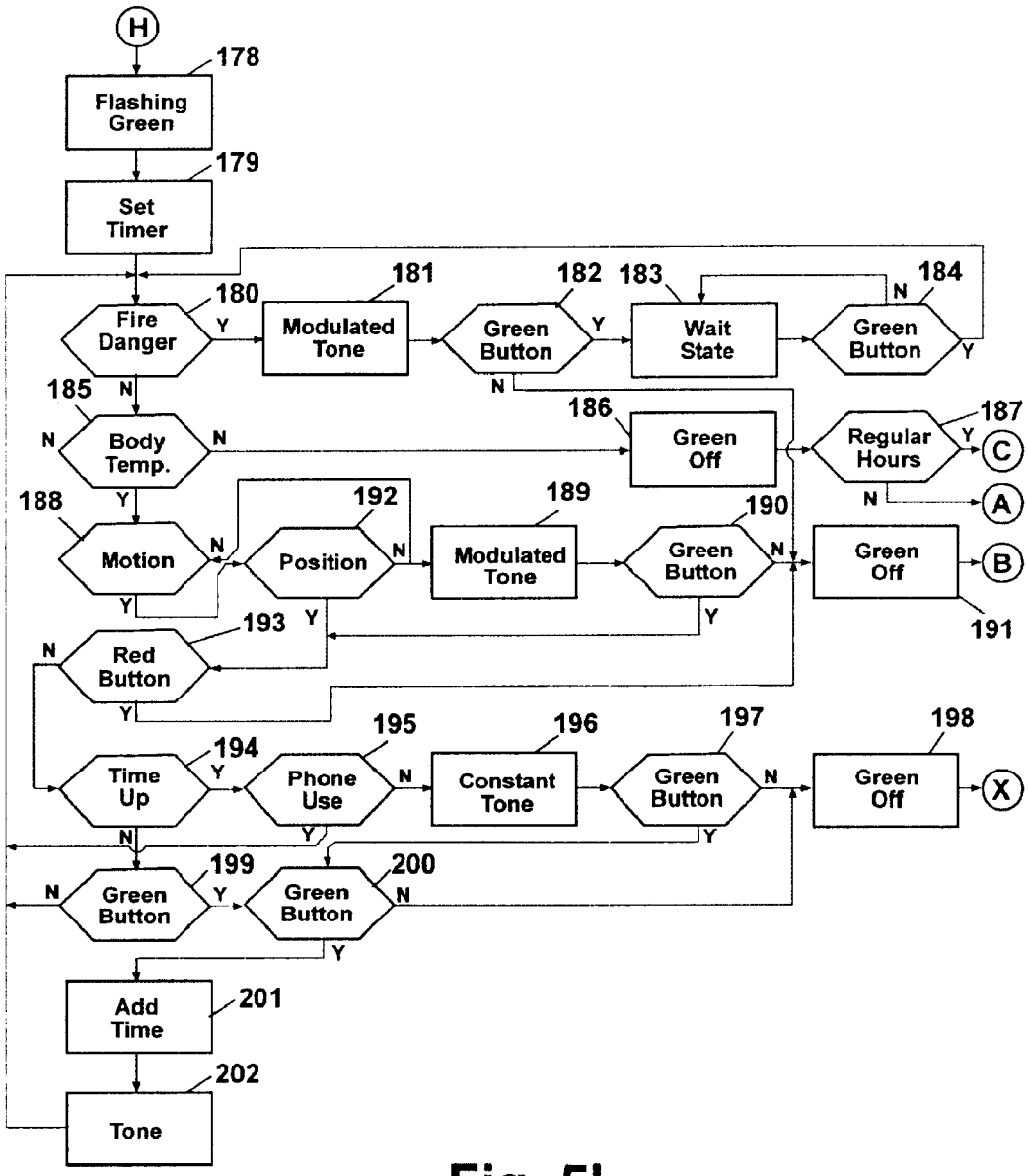

When Telephone Use Routine G in FIG. 5H is initiated, the green lights are switched from the constant mode to a flashing mode at step 160 as a "Do Not Disturb" signal. The space is then examined at step 161 for the presence of thermal energy at or above the minimum temperature level indicative of possible fire danger.

If the result is positive, a modulated tone is sounded at step 162 as a warning that the emergency alarm is about to be given. If the green button (or its personal computer equivalent) is not depressed at step 163, the flashing green lights are deactivated at step 172 and the program initiates Emergency Alarm Routine B in FIG. 5B. If the green button (or its personal computer equivalent) is depressed at step 163, a "wait state" is initiated at step 164 to allow time for eliminating the source of the possible fire danger. The "wait state" is continued until the green button (or its personal computer equivalent) is depressed at step 165, whereupon the program returns to step 161 to confirm that the source of the possible fire danger has been eliminated.

If the presence of thermal energy at or above the minimum temperature level indicative of possible fire danger is not sensed at step 161, the space is examined at step 166 for the continued presence of thermal energy falling within the normal temperature range of the human body. If the result is negative, the program concludes that the person has vacated the space. Consequently, the flashing green lights are deactivated at step 167 and a time check is made at step 168. If the current time is found to fall within a regular work shift, the program initiates Short-term Absence Routine C in FIG. 5D. Otherwise, it returns to step 1 of Main Routine A in FIG. 5A. If the presence of thermal energy falling within the normal temperature range of a human body is sensed at step 166, the program concludes that the person is still present in the space and makes a check at step 169 to determine whether he or she is moving. If not, the program concludes that the person is experiencing a possible physical emergency and a modulated tone is sounded at step 170 as a warning that the emergency alarm is about to be given. If the green button (or its personal computer equivalent) is not depressed at step 171, the flashing green lights are deactivated at step 172 and the program initiates Emergency Alarm Routine B in FIG. 5B. If the green button (or its personal computer equivalent) is depressed at step 171, activation of the emergency alarm is averted and the program concludes that the person is in a normal state and advances to step 174. If at step 169 the person is found to be moving, a check is made at step 173 to determine whether he or she is situated in a normal position. If not, the program concludes that the person is experiencing a possible physical emergency and executes steps 170 and 171 as just described. If so, the program concludes that the person is in a normal state and advances to step 174.

At step 174 the red button (or its personal computer equivalent) may be depressed to deactivate the flashing green lights at step 172 and initiate Emergency Alarm Routine B in FIG. 5B. Otherwise, a check for continued telephone use is made at step 175. If the result is negative, the flashing green lights are deactivated at step 176, and reactivated in the constant mode at step 177, and the program returns to step 49 of Main Routine A in FIG. 5A. If at step 175 telephone use is sensed, the program returns to step 161 to continue the telephone use routine.

When "Do Not Disturb" Routine H shown in FIG. 51 is initiated, the green lights are activated in a flashing mode at step 178 as a signal for the wish not to be disturbed and the internal timer is set for a predetermined amount of time at step 179. The space is then examined at step 180 for the presence of thermal energy at or above the minimum temperature level indicative of possible fire danger. If the result is positive, a modulated tone is sounded at step 181 as a warning that the emergency alarm is about to be given. If the green button (or its personal computer equivalent) is not depressed at step 182, the flashing green lights are deactivated at step 191 and the program initiates Emergency Alarm Routine B in FIG. 5B. If the green button (or its personal computer equivalent) is depressed at step 182, a "wait state" is initiated at step 183 to allow time for eliminating the source of the possible fire danger. The "wait state" is continued until the green button (or its personal computer equivalent) is depressed at step 184, whereupon the program returns to step 180 to confirm that the source of the possible fire danger has been eliminated.

If the presence of thermal energy at or above the minimum temperature level indicative of possible fire danger is not sensed at step 180, the space is examined at step 185 for the presence of thermal energy falling within the normal temperature range of a human body. If the result is negative, the program concludes that the person has vacated the space. Consequently, the flashing green lights are deactivated at step 186 and a time check is made at step 187. If the current time is found to fall within a regular work shift, the program initiates Short-Term Absence Routine C in FIG. 5D. Otherwise, it returns to step 1 of Main Routine A in FIG. 5A. If the presence of thermal energy falling within the normal temperature range of a human body is sensed at step 185, the program concludes that the person is still present in the space and makes a check at step 188 to determine whether he or she is moving. If not, the program concludes that the person is experiencing a possible physical emergency and sounds a modulated tone at step 189 as a warning that the emergency alarm is about to be given. If the green button (or its personal computer equivalent) is not depressed at step 190, the flashing green lights are deactivated at step 191 and the program initiates Emergency Alarm Routine B in FIG. 5B. If the green button (or its personal computer equivalent) is depressed at step 190, activation of the emergency alarm is averted and the program concludes that the person is in a normal state and advances to step 193. If at step 188 the person is found to be moving, a check is made at step 192 to determine whether he or she is situated in a normal position. If not, the program concludes that the person is experiencing a possible physical emergency and executes steps 189 and 190 as just described. If so, the program concludes that the person is in a normal state and advances to step 193.

At step 193 the red button (or its personal computer equivalent) may be depressed to deactivate the flashing green lights and initiate Emergency Alarm Routine B in FIG. 5B. Otherwise, a check is made at step 194 to determine whether the amount of time allocated for the "Do Not Disturb" period has expired. If so, a check is made for telephone use at step 195. If the result is positive, the program returns to step 180 to continue the owner-present "Do Not Disturb" period. If the result is negative, a constant tone is sounded at step 196 as a warning that the "Do Not Disturb" period is about to end. The green button (or its personal computer equivalent) may then be depressed at step 197 to extend the owner-present "Do Not Disturb" period as described below. Otherwise, the flashing green lights are deactivated at step 198 and the program returns to step 14 of Main Routine A in FIG. 5A. If at step 194 the amount of time allocated to the "Do Not Disturb" period is found not to have expired, the program advances to step 199 where the "Do Not Disturb" period may be allowed to run its course by taking no action. Alternatively, it may be ended or extended. If the green button (or its personal computer equivalent) is depressed at step 199 and not immediately depressed again at step 200, the flashing green lights are deactivated at step 198 and the program returns to step 14 of Main Routine A in FIG. 5A. If the green button (or its personal computer equivalent) is depressed at step 199 and immediately depressed again at step 200, a predetermined amount of time is added to the timer at step 201 and a confirming tone is sounded at step 202. The program then returns to step 180 to continue the owner-present "Do Not Disturb" routine.

Figure 5J:
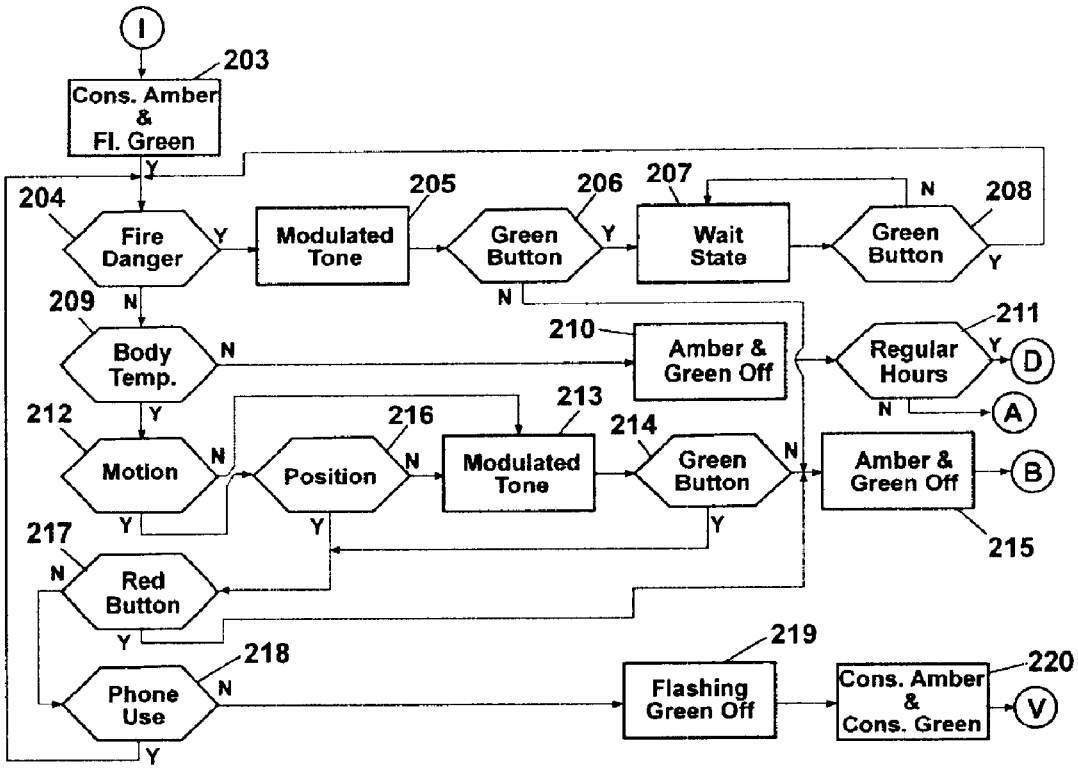

When Telephone Use Routine I in FIG. 5J is initiated, the amber lights are activated in the constant mode at step 203 while the green lights are simultaneously activated in a flashing mode as a signal that the visitor present in the space wishes not to be disturbed. The space is then examined at step 204 for the presence of thermal energy at or above the minimum temperature level indicative of possible fire danger. If the result is positive, a modulated tone is sounded at step 205 as a warning that the emergency alarm is about to be given. If the green button (or its personal computer equivalent) is not depressed at step 206, the constant amber and flashing green lights are deactivated at step 215 and the program initiates Emergency Alarm Routine B in FIG. 5B. If the green button (or its personal computer equivalent) is depressed at step 206, a "wait state" is initiated at step 207 to allow time for eliminating the source of the possible fire danger. The "wait state" is continued until the green button (or its personal computer equivalent) is depressed at step 208, whereupon the program returns to step 204 to confirm that the source of the possible fire danger has been eliminated.

If the presence of thermal energy at or above the minimum temperature level indicative of possible fire danger is not sensed at step 204, the space is examined at step 209 for the presence of thermal energy falling within the normal temperature range of a human body. If the result is negative, the program concludes that the visitor has vacated the space and deactivates the constant amber and flashing green lights at step 210 and makes a time check at step 211. If the current time is found to fall during a regular work shift, the program initiates Long-Term Absence Routine D in FIG. 5E. Otherwise, it returns to step 1 of Main Routine A in FIG. 5A. If the presence of thermal energy falling within the normal temperature range of a human body is sensed at step 209, the program concludes that the visitor is still present in the space and makes a check at step 212 to determine whether the he or she is moving. If not, the program concludes that the visitor is experiencing a possible physical emergency and sounds a modulated tone at step 213 as a warning that the emergency alarm is about to be given. If the green button (or its personal computer equivalent) is not depressed at step 214, the constant amber and flashing green lights are deactivated at step 215 and the program initiates Emergency Alarm Routine B in FIG. 5B. Otherwise, activation of the emergency alarm is averted and the program concludes that the visitor is in a normal state and advances to step 217. If at step 212 the visitor is found to be moving, a check is made at step 216 to determine whether he or she is situated in a normal position. If not, the program concludes that the visitor is experiencing a possible physical emergency and executes steps 213 and 214 as just described. If so, the program concludes that the visitor is in a normal state and advances to step 217.

At step 217 the red button (or its personal computer equivalent) may be depressed to deactivate the constant amber and flashing green lights at step 215 and initiate Emergency Alarm Routine B in FIG. 5B. Otherwise, a check is made at step 218 to determine if the telephone is still in use. If not, the flashing green light is deactivated at step 219, the amber and green lights are simultaneously reactivated in the constant mode at step 220, and the program returns to step 127 to continue the visitor-present portion of Long-term Absence Routine E in FIG. 5F. If at step 218 telephone use is still sensed, the program returns to step 204 to continue the visitor-present telephone use routine.

Figure 5K:
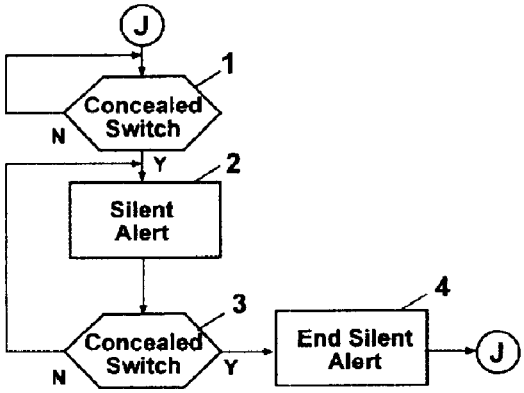

FIG. 5K presents a flowchart of the firmware for the sending of a silent alert to one or more remote locations without giving any audio-visual indication at the originator's location. When concealed switch 117 shown in FIGS. 1A–4A is actuated at step 1, a silent alert is sent at step 2 to one or more remote locations. The silent alert is continued until the concealed switch is actuated again at step 3. The silent alert is then deactivated at step 4 and the program returns to step 1.

While the present occupant status monitor has been described in connection with certain specific embodiments thereof, this description is by way of illustration and not by way of limitation. Consequently, the scope of the appended claims should be construed as broadly as the prior art will permit.

What is claimed is:

1. An occupant status monitor comprising:

a detector disposed to sense a plurality of parameters of thermal energy in and relative to a given space wherein the parameters are temperature, size, shape, motion, time, and position, and to transmit data representative of said parameters;

a processor disposed to receive data transmitted by the detector, to compare that data with a predetermined data set representative of attributes of one of a person and of the space, and to transmit a plurality of instructions, each of said instructions being dependent upon the results of at least one comparison; and an indicator disposed to receive the instructions from the processor and to activate signals about the status of a person relative to the space based upon the instructions received from the processor, whereby upon a comparison by the processor of the data transmitted by the detector with the predetermined data sets, the signals activated by the indicator will show whether the space is or has been occupied and the status of an occupant relative to the space.

2. An occupant status monitor according to claim 1 wherein the detector is at least one passive infrared receptor.

3. An occupant status monitor according to claim 1 wherein the processor is a microcomputer housed in a stand-alone control module.

4. An occupant status monitor according to claim 1 wherein the processor is a personal computer.

5. An occupant status monitor according to claim 1 wherein the indicator comprises an audiovisual display.

6. An occupant status monitor according to claim 5 wherein the display consists of at least three lights and a tone generator.

7. An occupant status monitor according to claim 5 wherein the display is activated by means of a personal computer.

8. An occupant status monitor according to claim 1, wherein the indicator is remote from the space.

9. An occupant status monitor according to claim 6 wherein a first of the at least three lights and the tone generator are activated in an intermittent mode to signal a first occupant status when a person is present in the space and is experiencing a physical emergency; and wherein a second of the at least three lights is activated in the constant mode to signal a second occupant status when a person is present in the space and is not experiencing a physical emergency; and wherein a third of the at least three lights is activated in an intermittent mode to signal a third occupant status when a person has vacated the space briefly within a predetermined time period; and wherein none of the at least three lights or the tone generator is activated when no person is present in the space outside of the predetermined time period.

10. An occupant status monitor according to claim 3 wherein the control module further comprises a switch actuatable by an occupant of the space wherein a first of the at least three lights and the tone generator can be activated by an occupant in an intermittent mode to signal a first occupant status wherein the occupant is experiencing an emergency.

11. An occupant status monitor according to claim 3 wherein the control module further comprises a switch actuatable by an occupant of the space wherein a second of the at least three lights can be activated by an occupant in an intermittent mode to signal a variation of the second occupant status wherein the occupant is unwilling to be disturbed.

12. An occupant status monitor according to claim 3 wherein the control module further comprises a switch actuatable by an occupant of the space wherein a third of the at least three lights can be activated by an occupant in the constant mode to signal a variation of the third occupant status wherein the vacation of the space is anticipated to be of a long duration.

13. An occupant status monitor according to claim 10 wherein the tone generator sounds a constant tone to announce that the signal for the first occupant status is about to be activated.

14. An occupant status monitor according to claim 11 wherein a timer commences measuring a predetermined period of time allocated for signaling the unwillingness to be disturbed and the tone generator sounds a modulated tone shortly before the predetermined time period expires.

15. An occupant status monitor according to claim 3 wherein the control module further comprises a connection to a sensor disposed to discern whether or not a telephone in the space is in use, the sensor being further disposed to transmit an indication of a change in usage of the telephone.

16. An occupant status monitor according to claim 15 wherein when the sensor indicates usage of the telephone in the space, a second of the at least three lights will be automatically activated in an intermittent mode to signal the variation of the second occupant status wherein the occupant is unwilling to be disturbed.

17. An occupant status monitor according to claim 15, wherein when the sensor further indicates discontinuance of usage of the telephone in the space, a second of the at least three lights will be automatically activated in a constant mode to signal the second occupant status wherein the occupant is willing to be disturbed.

18. An occupant status monitor according to claim 3, wherein the control module is further adapted to replicate the visual portion of the occupant status signals.

19. An occupant status monitor according to claim 3, wherein the control module is further connected to a communication network and the occupant status signals are remotely accessible.

20. An occupant status monitor according to claim 4 wherein the personal computer is disposed to activate the status signals manually.

21. An occupant status monitor according to claim 4 wherein the personal computer is further connected to a communications network and the occupant status signals are remotely accessible and remotely actuable.

22. An occupant status monitor according to claim 1 wherein the parameter detected by the detector is temperature and the predetermined data set includes a value representing a minimum temperature indicative of fire danger, whereby when the temperature parameter data transmitted by the detector exceeds the predetermined data set value, the instruction sent from the processor will cause the indicator to activate the first occupant status signal as an alarm about a possible fire in the space.

23. An occupant status monitor comprising:

a detector disposed to sense a plurality of parameters of thermal energy in and relative to given space wherein the parameters are temperature, size, shape, motion, time, and position, and to transmit data representative of said parameters;

a processor disposed to receive data transmitted by the detector, to compare that data with a predetermined data set representative of attributes of one of a person and of the space, and to transmit a plurality of instructions, each of said instructions being dependant upon the results of at least one comparison; and an indicator disposed to receive the instructions from the processor and to activate signals about the status of a person relative to the space based upon the instructions received from the processor, whereby upon a comparison by the processor of the data transmitted by the detector with a predetermined data set, the signals activated by the indicator will show whether the space is or has been occupied and the status of an occupant relative to the space.

24. An occupant status monitor comprising:

a detector disposed to sense a plurality of parameters of thermal energy in and relative to a given space wherein the parameters are temperature, size, shape, motion, time, and position, and to transmit data representative of said parameters;

a processor disposed to receive data transmitted by the detector, to compare that data with a predetermined data set representative of attributes of one of a person and of the space, and to transmit a plurality of instructions, each of said instructions being dependant upon the results of at least one comparison; and an indicator comprising an audiovisual display of three lights and a tone generator, and disposed to receive the instructions from the processor and to display information about the status of a person relative to the space based upon the instructions received from the processor, wherein a first of the at least three lights and the tone generator are activated in an intermittent mode to signal a first occupant status when a person is present in the space and is experiencing a physical emergency; and wherein a second of the at least three lights is activated in the constant mode to signal a second occupant status when a person is present in the space and is not experiencing a physical emergency; and wherein a third of the at least three lights is activated in an intermittent mode to signal a third occupant status when a person has vacated the space briefly within a predetermined time period; and wherein none of the at least three lights or the tone generator is activated when no person is present in the space outside of the predetermined time period.

25. An occupant status monitor comprising:

a detector disposed to sense a plurality of parameters in and relative to a given space wherein the parameters are temperature, size, shape, motion, time, location, and position, and to transmit data representative of said parameters;

a processor disposed to receive data transmitted by the detector, to compare that data with a predetermined data set representative of attributes of one of a person and of the space, and to transmit a plurality of instructions, each of said instructions being dependent upon the results of at least one comparison; and an indicator disposed to receive the instructions from the processor and to display information about the status of a person relative to the space based upon the instructions received from the processor, wherein the indicator will display information representing a first occupant status when a person is present in the space and is experiencing a physical emergency; a second occupant status when a person is present in the space and is not experiencing a physical emergency; a third occupant status when a person has vacated the space within a predetermined time period; and a fourth occupant status when no person is present in the space outside of the predetermined time period.

26. An occupant status monitor according to claim 25 wherein the detector is at least one passive infrared receptor.

27. An occupant status monitor according to claim 25 wherein the processor is a microcomputer housed in a stand-alone control module.

28. An occupant status monitor according to claim 25 wherein the processor is a personal computer.

29. An occupant status monitor according to claim 25 wherein the indicator comprises an audiovisual display.

30. An occupant status monitor according to claim 25 wherein the control module further comprises a switch actuatable by an occupant of the space causing the indicator to display information representing the first occupant status wherein the occupant is experiencing an emergency.

31. An occupant status monitor according to claim 25 wherein the control module further comprises a switch actuatable by an occupant of the space causing the indicator to display information representing the second occupant status wherein the occupant is unwilling to be disturbed.

32. An occupant status monitor according to claim 25 wherein the control module further comprises a switch actuatable by an occupant of the space to signal that vacation of the space is anticipated to be of a long duration.

33. An occupant status monitor according to claim 25 wherein a brief audio signal is generated before the indicator displays information representing the first occupant status.

34. An occupant status monitor according to claim 25 wherein the control module further comprises a switch actuatable by an occupant of the space causing the indicator to discontinue display information representing the first occupant status wherein the occupant is experiencing an emergency.

35. An occupant status monitor according to claim 25 wherein a timer commences measuring the predetermined period of time allocated for signaling the unwillingness to be disturbed and an audio signal is generated shortly before the predetermined time period expires.

36. An occupant status monitor according to claim 25 wherein the control module further comprises a connection to a sensor disposed to discern whether or not a telephone in the space is in use, the sensor being further disposed to transmit an indication of a change in usage of the telephone.

37. An occupant status monitor according to claim 34 wherein when the sensor indicates usage of the telephone in the space, the indicator will display a variation of the second occupant status wherein the occupant is unwilling to be disturbed.

38. An occupant status monitor according to claim 34, wherein when the sensor further indicates discontinuance of usage of the telephone in the space, indicator will display a variation of the second occupant status wherein the occupant is willing to be disturbed.

39. An occupant status monitor according to claim 25, wherein the control module is further connected to a communication network and the indicator display is remotely accessible.

* * * * *